US005427133A

United States Patent [19]

Pringle

[11] Patent Number: 5,427,133

[45] Date of Patent: Jun. 27, 1995

[54] COILED TUBING WIRELINE RETRIEVABLE AND SELECTIVE SET GAS LIFT ASSEMBLY

[75] Inventor: Ronald E. Pringle, Houston, Tex.

[73] Assignee: Camco International Inc., Houston, Tex.

[21] Appl. No.: 112,038

[22] Filed: Aug. 26, 1993

[51] Int. Cl.[6] ..... F04F 1/08

[52] U.S. Cl. ..... 137/155; 417/115

[58] Field of Search ..... 137/155; 166/77, 380, 166/237, 325, 117.5; 417/115

[56] References Cited

U.S. PATENT DOCUMENTS 4,002,203 1/1977 Terrall ..... 166/117.5
4,295,796 10/1981 Moore ..... 137/155 X
4,726,421 2/1988 Akkerman et al. ..... 166/117.5
5,170,815 12/1992 Going, III et al. ..... 137/155

*Primary Examiner*—Martin P. Schwadron
*Assistant Examiner*—Kevin L. Lee
*Attorney, Agent, or Firm*—Fulbright & Jaworski

[57] ABSTRACT

A gas lift assembly and gas lift valve positioned in coiled tubing in which the coiled tubing housing and gas lift valve are flexible for allowing the coiled tubing to be spooled. The gas lift valve is wireline retrievable for allowing gas lift valves to be removed for allowing other tools to pass through the coiled tubing. The gas lift valves are selective in that they will seat a selected coiled tubing housing as each valve will match a mating coiled tubing housing.

11 Claims, 3 Drawing Sheets

Fig. 6A
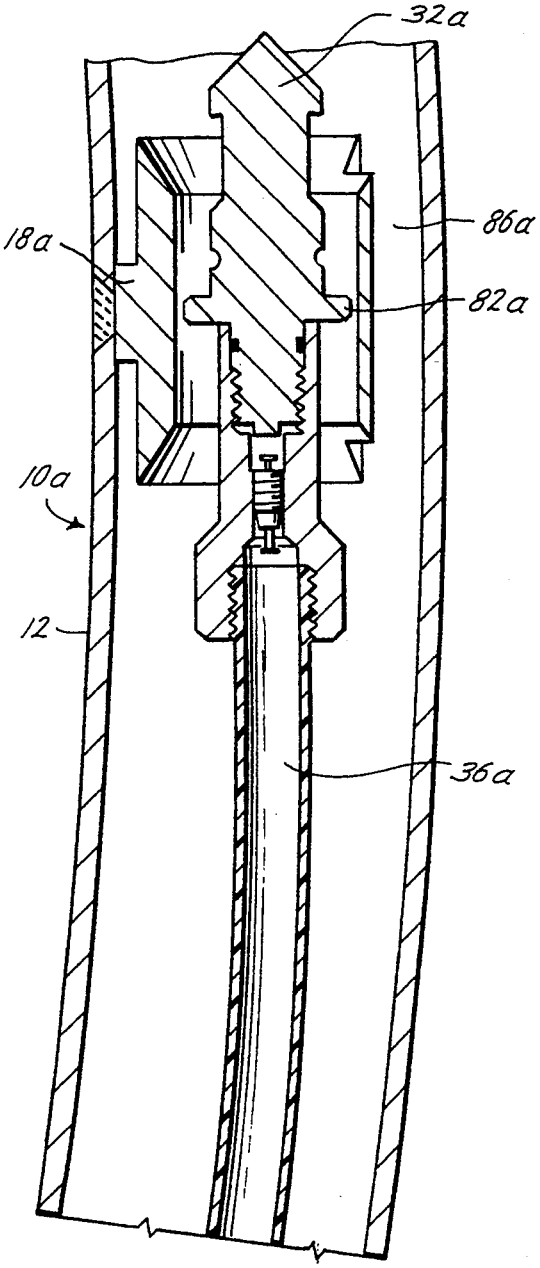
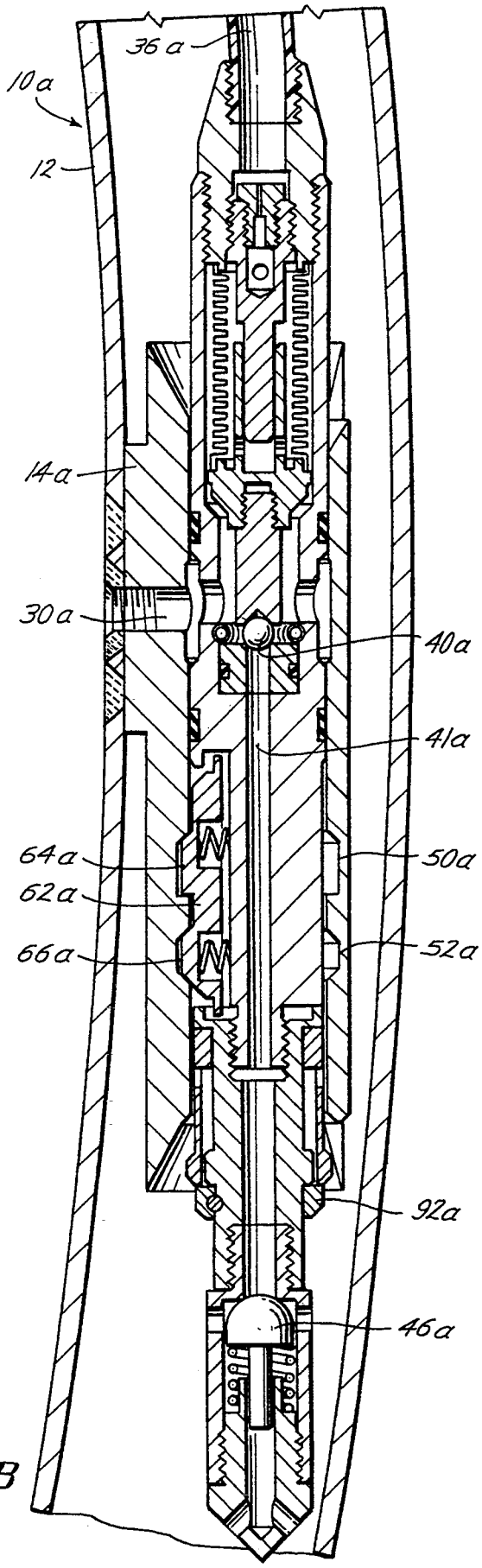
Fig. 6B

COILED TUBING WIRELINE RETRIEVABLE AND SELECTIVE SET GAS LIFT ASSEMBLY

BACKGROUND OF THE INVENTION

The present invention is directed to a gas lift assembly for use in coiled tubing, and more particularly to a wireline retrievable, selective, flexible and spoolable gas lift valve for releasably seating in a selected mating coiled tubing housing.

Gas lift valves have long been used to inject lift gas into wells at selected depths for the purpose of forcing liquids, such as oil, to the surface of the well.

U.S. Pat. No. 5,170,815 discloses the use of a flexible gas lift assembly including a gas lift valve mounted within a coiled tubing. Such systems can replace expensive workover rigs. Such valves are permanently mounted within the internal diameter of the coiled tubing and have the advantage that the coiled tubing and valves are flexible and spoolable on the coiled tubing reel. However, such permanently mounted gas lift valves prevent through tubing wireline work, such as bottom hole pressure and temperature surveys, which are desirable. In such a system the entire coiled tubing must be pulled in order to perform downhole wireline work.

The present invention is directed to a coiled tubing retrievable and selective gas lift assembly in which the coiled tubing and gas lift valves are flexible and spoolable along with the coiled tubing, but the gas lift valves can be removed from the coiled tubing by wireline and may be reinstalled by wireline with each valve mating with a coacting and matching coiled tubing housing in a coiled tubing having a plurality of housing assemblies.

SUMMARY

The present invention is directed to a coiled tubing gas lift assembly having gas lift valves therein and are wireline retrievable without withdrawing the coiled tubing from the well bore.

A still further object of the present invention is to selectively set a plurality of gas lift valves within coiled tubing at various downhole locations.

Still a further object of the present invention is the provision of a coiled tubing housing assembly in a coiled tubing for receiving a gas lift valve which includes a tubular member positioned in the coiled tubing and having a bore therethrough and having first and second ends. The tubular member is adapted to receive a retrievable gas lift valve in the bore. A port is provided between the first and second ends extending between the inside of the tubular member and the outside of the coiled tubing. Selective holding and releasing means are provided in the assembly for selectively engaging, holding and releasing a gas lift valve in the bore.

Yet a further object of the present invention is the provision of a housing assembly including centralizer means in the coiled tubing above the tubular member for generally aligning the top of the gas lift valve in the center of the coiled tubing.

Still a further object of the present invention is wherein the first and second ends of the tubular member are tapered inwardly forming guide surfaces for guiding the passage of gas lift valves into the tubular member from above and from below the tubular member.

Still a further object of the present invention is wherein the centralizer means includes first and second ends which are tapered inwardly forming guide surfaces.

Yet a still further object of the present invention is the combination of a selective, spoolable, retrievable gas lift valve, with the housing assembly of the present invention, in which the gas lift valve is longitudinally flexible and has first and second ends in which the first end has a fishing head for connection to a setting or retrieving tool and the valve includes coacting selective holding and releasing means for mating with selective holding and releasing means on a tubular member.

Still a further object of the present invention is the improvement in a longitudinally flexible gas lift valve for use in a coiled tubing having an elongate body with an inlet, an outlet, a valve controlled by a gas containing compartment, and a check valve in which the improvement includes selectively holding and releasing means on the body coacting with the inside of a coiled tubing for selectively engaging, holding and releasing the valve at a selected position in the coiled tubing.

A still further object of the present invention is the provision of a coiled tubing having a plurality of coiled tubing housing assemblies each of which receives a selected gas lift valve in which each housing assembly includes a tubular member positioned in the coiled tubing and having a bore therethrough and having first and second ends in which the ends each form a guide surface. A port is provided between the first and second ends extending between the inside of the tubular member and the outside of the coiled tubing and selective holding and releasing means are provided in the assembly for selectively engaging, holding and releasing a retrievable gas lift valve in the bore. The selective holding and releasing means in each assembly will engage and hold a different gas lift valve from the other assemblies.

Still a further object of the present invention is the combination of the plurality of coiled tubing housings with a plurality of retrievable gas lift valves, each of which will seat in only one of the housing assemblies.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While a particular individual type of gas lift assembly will be described, it is to be understood that the coiled tubing will include one or more gas lift assemblies of the present invention vertically connected in the coiled tubing and spaced from each other. Furthermore, while the specific disclosed gas lift structure illustrates the method of injecting lift gas downwardly through the annulus outside of the coiled tubing and discharging the gas through each gas lift assembly into the coiled tubing thereby lifting well fluids through the coiled tubing, it is to be understood that the direction may be reversed and the lift gas can be injected through the coiled tubing and out into the annulus.

Figure 1A:
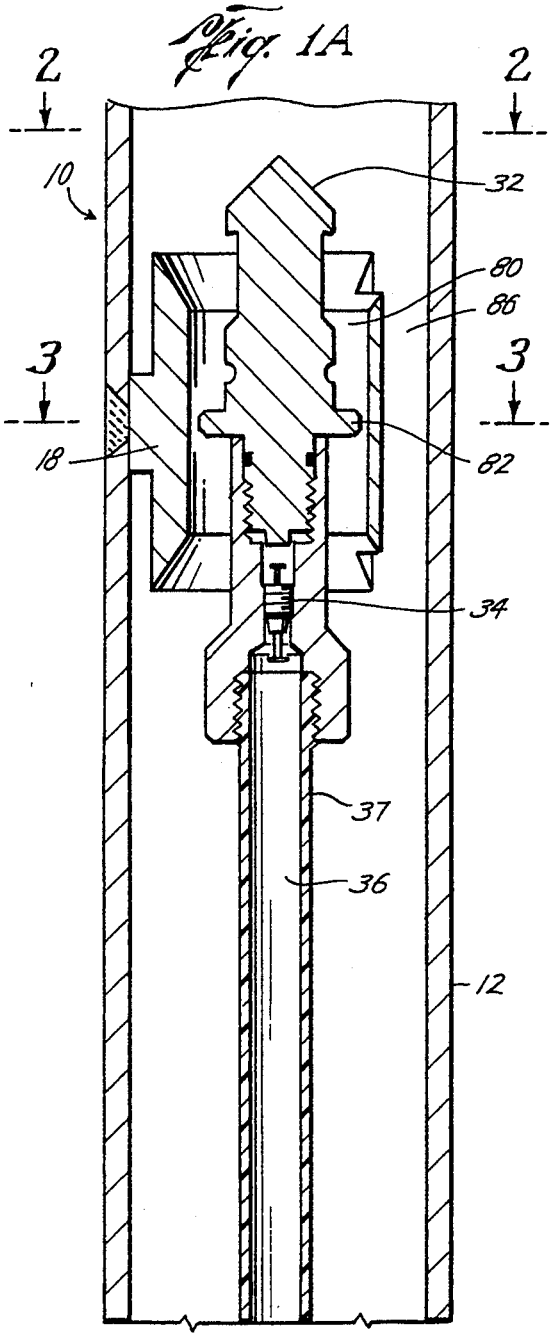
FIGS. 1A and 1B are continuations of each other and form a fragmentary, elevational view, in cross section, of the present invention.
Figure 1B:
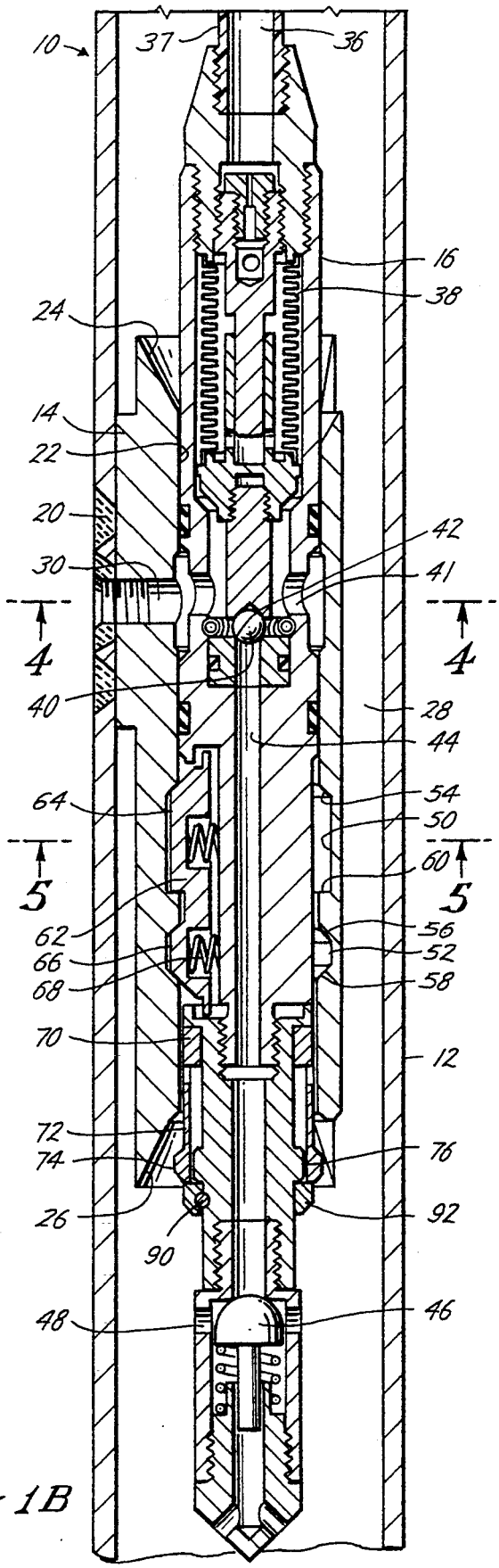

Referring now to the drawings, and particularly to FIGS. 1A and 1B, the reference numeral 10 generally indicates the coiled tubing gas lift assembly and generally includes coiled tubing 12, a tubular member or nipple 14, a gas lift valve 16, and a centralizer 18.

Figure 4:
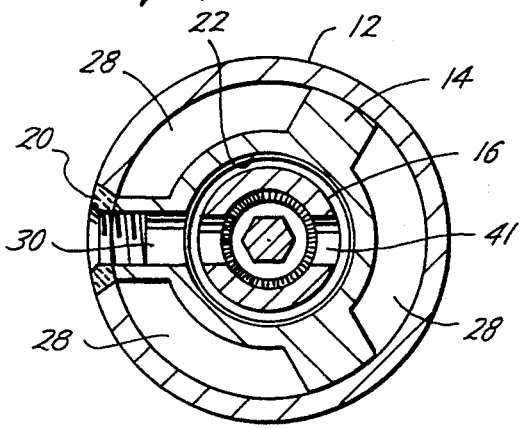
FIG. 4 is a cross-sectional view taken along the line 4—4 of FIG. 1B.
Figure 5:
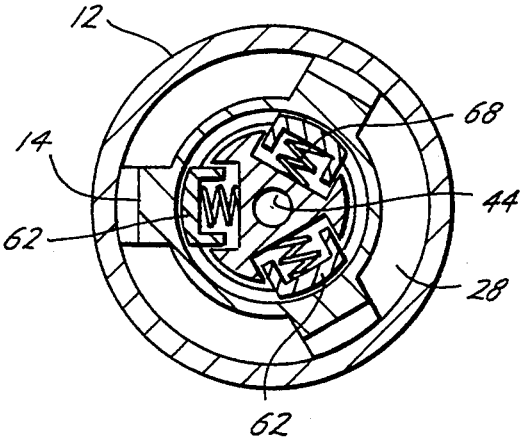
FIG. 5 is a cross-sectional view taken along the line 5—5 of FIG. 1B, and FIGS. 6A and 6B are continuations of each other and form a fragmentary, elevational view, in cross section, similar to FIGS. 1A and 1B, but in which the invention is flexed and a different coacting selective means from that shown in FIG. 1B is shown.

Referring now to FIGS. 1B, 4 and 5, a tubular member 14 is positioned in the coiled tubing 12 and secured therein, such as by welds 20. The tubular member 14 includes a bore 22 for receiving the gas lift valve 16. Tubular member 14 also includes a first end 24 and a second end 26, both of which are preferably tapered inwardly for providing guide surfaces for guiding the passage of a gas lift valve downwardly or upwardly into or through the housing 14. A pore 80 extends between the first and second ends 24 and 26 between the inside of the tubular member 14 and the outside of the coiled tubing 12 to provide a gas passage between the annulus around the coiled tubing 12 and ports 41 in the gas lift valve 16. The tubular member 14 includes a plurality of passageways 28 for allowing fluid flow through the coiled tubing 12 while the gas life valve 16 is sealed in the tubular member 14.

The gas lift valve 16, as shown, upon actuation, admits gas from the annulus around the coiled tubing 12 into the inside of the coiled tubing 12 to lift well liquids therein. The gas lift valve 16 generally includes a running and fishing head 32, a dill valve 34, for admitting pressurized gas into a gas chamber 36 for acting on the inside of a bellows 38 for urging a valve element 40 onto a seat 42 for closing passageway 44. A check valve 46 is spring-biased to normally close the bottom of the passageway 44. When it is desired to inject gas through the gas lift valve 16, the annulus outside of the coiled tubing 12 is pressured up to a sufficient gas pressure which passes through the ports 30 and gas ports 41 in the gas lift valve 16 to act against the outside of the bellows 38 and overcome the pressure charged therein to lift the valve element 40 away from the valve seat 42 allowing the passage of the injected gas through the passageway 44 thereby opening the check valve 46 and flowing out of openings 48 into the interior of the coiled tubing 12. Of course, the flow mechanics of the gas lift valve 16 may be reversed to provide gas lift injection from the inside of the coiled tubing 12 to the outside.

The gas lift valve 16 is longitudinally flexible for allowing the valves to be inserted into the coiled tubing 12 and be spooled onto a reel along with the coiled tubing. In FIGS. 6A and 6B, another gas lift assembly is positioned above the assembly shown in FIGS. 1A and 1B, is shown in a flexed position with like parts similarly numbered but with the addition of the suffix "a". In the embodiment shown in FIGS. 1A and 1B, the gas chamber 36 is enclosed by a gas housing 37 which may be made out of any flexible material such as a plastic and in particular one sold under the trademark PEEK, which is the generic name of polyetheretherketone. Of course, the gas lift valve 16 may be made flexible by using any of the constructions disclosed in U.S. Pat. No. 5,170,815.

However, in order to allow wireline operations to be conducted inside of the coiled tubing 12, the gas lift valves in the coiled tubing 12 are retrievable and are retrieved by wireline without removing the coiled tubing 12 from the well. And after other wireline work has been performed, the gas lift valves may be reinstalled into the coiled tubing 12 by wireline. However, in order to accomplish these functions each of the plurality of gas lift valves in the coiled tubing 12 must be selective. This means each individual valve will seat in only its matching tubular housing 14. This selectivity is necessary so that the first gas lift valve run into the coiled tubing 12 does not set in the first or top tubular member 14, but passes through one or more tubular housings 14 to land and set in the bottom nipple or tubular housing 14. That is, all of the lower gas lift valves will pass through all of the tubular members 14 above its selective and mating nipple or tubular member 14. As will be described, gas lift valve 16 will seat in member 14 (FIG. 1B) but will not seat in uphole member **14*a*** (FIG. 6B).

Referring now to FIG. 1B, selective holding and releasing means are provided between the gas lift valve 16 and the tubular member 14 for selectively engaging, holding and releasing the gas lift valve 16. The selective means on the tubular member 14 includes a particular profile such as a long slot 50 and a short slot 52 of particular length and spacing relative to each other. The selected profiles 50 and 52 generally include tapered ends 54, 56 and 58 for allowing upper and lower passageway of the valve 16 but include a stop and holding shoulder 60 for engaging a coacting profiled key 62 on the gas lift valve 16 for supporting the gas lift valve 16 in the tubular member 14. The selective means on the gas lift valve 16 includes a plurality of keys 62 having profiles 64 and 66, respectively, for coacting with and engaging the profiles 50 and 52. The keys 62 are spring-biased outwardly by springs 68. If the profiles 64 and 66 do not match the profiles 50 and 52, the keys 62 will not seat in the tubular member 14, but will pass on downwardly therethrough to a lower positioned tubular housing for finding a matching profile.

Referring to FIG. 6B, another tubular member 14a is positioned in the coiled tubing 12 at an uphole location from the tubular member 14. It is to be noted that the profiles **50*a* and 52*a* and their coacting profiles 64*a* and 66*a* on the key 62*a* are different from the profiles shown in FIG. 1B. Therefore, the safety valve 16 will not seat in the tubular member 14*a* but will only seat in tubular member 14**.

In order to hold the gas valve 16 in the tubular member 14 and prevent any pressure in the coiled tubing 12 therebelow from pushing the gas lift valve upwardly a collet latch 70 having a plurality of collet fingers 72 with dogs 74 is telescopically slidable and movable on the body of the gas lift valve 16. When the gas lift valve 16 is inserted downwardly into the tubular member 14, the collet member 70 and dogs 74 will move upwardly away from a backup shoulder 76 to allow the gas lift valve to pass through the bore 22 of the tubular member 14. After passing through the bore 22 and upon seating in the tubular member 14, the collet 70 will move downwardly by gravity or by springs (not shown) to position the dogs 74 against the backup shoulder 76 thereby locking the gas lift valve 16 in the tubular member 14.

Figure 2:
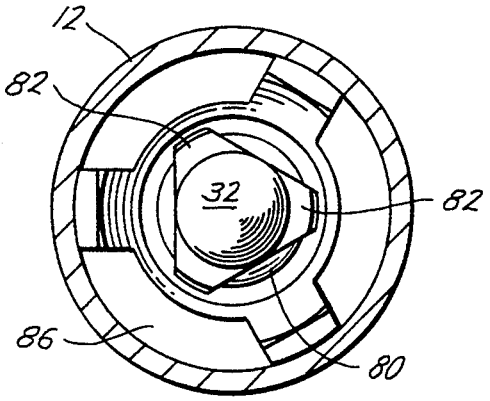
FIG. 2 is a cross-sectional view taken along the line 2—2 of FIG. 1A.
Figure 3:
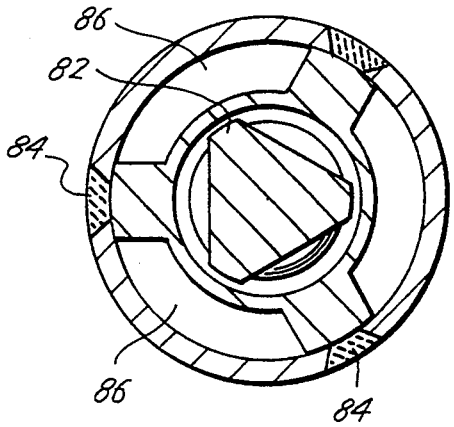
FIG. 3 is a cross-sectional view taken along the line 3—3 of FIG. 1A.

Since the gas lift valve 16 is flexible, and referring to FIGS. 1A, 2 and 3, the running and fishing head 32 could, after setting the valve 16, lie against one side of the inside of the coiled tubing 12 which would make retrieving the gas lift valve 16 by a pulling tool more difficult. Therefore, as shown, a centralizer 18 is provided which has a tubular bore 80 which encloses the head 32 and a protrusion 82 to generally hold the head 32 in alignment with the longitudinal axis of the coiled tubing 12, However, the centralizer 18 while secured to the inside of the coiled tubing 12 by welds 84 also includes passageways 86 for allowing fluid flow therethrough.

In installing a gas lift valve 16 with a suitable setting tool, such as Camco Model "JK" running tool engages the head 32 and the gas lift valve 16 is lowered into the coiled tubing 12 passing through any nipples or tubular members 14 having a selected profile 50 and 52 which do not match the coacting profiles 64 and 66 on the gas valves 16. When the valve 16 reaches a location in the coiled tubing 12 that includes a matching tubular housing 14 the gas lift valve 16 will seat therein and be locked in position when the running tool is jarred loose. The other gas lift valves thereabove are similarly installed. When it is desired to remove the gas lift valve, a retrieving tool such as Camco Model "JDC" pulling tool engages the head 32 and an upper pull will bring the dogs 74 against the bottom of the tubular housing 14 shearing pin 90 and allowing ring 92 to fall downwardly whereby the dogs 74 may move pass the backup shoulders 76 and pass through the bore 22 of the tubular member 14. Because of the tapered ends 54, 56 and 58, the selector keys 62 will move out of the selective profiles 50 and 52.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. A coiled tubing housing assembly in a coiled tubing for receiving a gas lift valve comprising, a tubular member positioned in the coiled tubing and having a bore therethrough and having first and second ends, the tubular member adapted to receive a retrievable gas lift valve in the bore;

a port between the first and second ends extending between the inside of the tubular member and the outside of the coiled tubing;

selectively engaging and holding means in the tubular member including a selected profile for coacting only with a selected gas lift valve having a coacting profile, and a locking shoulder on the tubular member for releasably holding the gas lift valve in the tubular member.

2. The housing assembly of claim 1 including, centralizer means in the coiled tubing above the tubular member for generally aligning the top of the gas lift valve in the center of the coil tubing.

3. The housing assembly of claim 1 wherein said tubular member first and second ends are tapered inwardly forming guide surfaces.

4. The housing assembly of claim 2 wherein the centralizer means includes first and second ends which are tapered inwardly forming guide surfaces.

5. A selective, spoolable, retrievable gas lift valve and housing assembly in a coiled tubing comprising:

a tubular member positioned in the coiled tubing and having a bore therethrough and first and second ends, the tubular member adapted to receive a retrievable and flexible gas lift valve in the bore;

a port between the first and second ends extending between the inside of the tubular member and the outside of the coiled tubing;

a longitudinally flexible retrievable gas lift valve having first and second ends, the first end having a head for connection to a setting or retrieving tool;

selectively coacting engaging and holding means between the inside of the tubular member and the gas lift valve including particularly profiled coacting slots and keys for allowing the gas lift valve to be selectively engaged and supported in the tubular member, and coacting releasing means between the tubular member and the gas lift valve for releasably holding the gas lift valve in the tubular member.

6. The housing assembly of claim 5 including, centralizer means in the coiled tubing above the tubular member for generally aligning the top of the gas lift valve in the center of the coil tubing.

7. The housing assembly of claim 5 wherein said tubular member first and second ends are tapered inwardly forming guide surfaces.

8. The housing assembly of claim 5 wherein the centralizer means includes first and second ends which are tapered inwardly forming guide surfaces.

9. In a longitudinally flexible gas lift valve for use in a coiled tubing having an elongate body with an inlet, an outlet, a valve controlled by a gas containing compartment, and a check valve, the improvement comprising:

selectively engaging and holding means on the body including a selected profile for coacting only with a housing in a coiled tubing having a coacting profile for receiving the gas lift valve, and releasable locking means on the body for coacting with said housing for releasably holding the gas lift valve in the housing.

10. A coiled tubing having a plurality of coiled tubing housing assemblies each of which receives a selected gas lift valve comprising:

each housing assembly including, a tubular member positioned in the coiled tubing and having a bore therethrough and having first and second ends, said ends each forming a guide surface;

a port between the first and second ends extending between the inside of the tubular member and the outside of the coiled tubing;

selectively engaging and holding means in each tubular housing in each housing assembly including a selected profile, the profile in each housing assembly having a differing profile from the profiles in other housing assemblies, for allowing a plurality of gas lift valves having differing coacting profiles to be selectively engaged and supported in one of the housing assemblies; and a locking shoulder on the tubular member for releasably holding the gas lift valve in the tubular member.

11. The coiled tubing of claim 10 including:

a plurality of retrievable gas lift valves, each of which will selectively seat in one of the housing assemblies.

* * * * *